United States Patent [19]

MacLaughlin

[11] Patent Number: 4,627,492

[45] Date of Patent: Dec. 9, 1986

[54] WELL TOOL HAVING LATCHING MECHANISM AND METHOD OF UTILIZING THE SAME

[75] Inventor: Scott T. MacLaughlin, Duncan, Okla.

[73] Assignee: Halliburton Company, Duncan, Okla.

[21] Appl. No.: 780,070

[22] Filed: Sep. 25, 1985

[51] Int. Cl.[4] ..... E21B 34/12; E21B 43/12

[52] U.S. Cl. ..... 166/250; 166/152; 166/237; 166/323; 166/334; 166/386

[58] Field of Search ..... 166/250, 373, 386, 72, 166/73, 113, 152, 323, 332, 334, 237, 242, 238; 285/306, 83, 315; 73/40.5 R, 49.1

[56] References Cited

U.S. PATENT DOCUMENTS

| | | | |
|---|---|---|---|
| Re. 29,471 | 11/1977 | Giroux | 166/334 |
| 2,742,093 | 4/1956 | Vaughn | 73/40.5 R |
| 2,962,096 | 11/1960 | Knox | 285/315 |
| 3,332,495 | 7/1967 | Young | 166/152 |
| 3,427,048 | 2/1969 | Brown | 285/315 |
| 3,446,280 | 5/1969 | Nutter | 166/152 |
| 3,470,903 | 10/1969 | Scott | 166/334 |
| 3,614,984 | 10/1971 | Schexnaider | 166/152 |
| 3,664,415 | 5/1972 | Wray et al. | 166/162 |
| 3,779,263 | 12/1973 | Edwards et al. | 137/68 |
| 3,850,250 | 11/1974 | Holden et al. | 166/95 |
| 3,858,649 | 1/1975 | Wray et al. | 166/162 |
| 3,964,544 | 6/1976 | Farley et al. | 166/264 |
| 3,970,147 | 7/1976 | Jessup et al. | 166/250 |
| 4,047,564 | 9/1977 | Nix et al. | 166/72 |
| 4,063,593 | 12/1977 | Jessup | 166/317 |
| 4,064,937 | 12/1977 | Barrington | 166/162 |
| 4,109,724 | 8/1978 | Barrington | 166/321 |
| 4,113,018 | 9/1978 | Barrington et al. | 166/334 |
| 4,270,610 | 6/1981 | Barrington | 166/317 |
| 4,281,715 | 8/1981 | Farley | 166/317 |
| 4,295,361 | 10/1981 | McMahan | 73/40.5 R |
| 4,319,633 | 3/1982 | McMahan et al. | 166/250 |
| 4,319,634 | 3/1982 | McMahan et al. | 166/250 |
| 4,420,045 | 12/1983 | McMahan | 166/334 |
| 4,421,172 | 12/1983 | McMahan | 166/334 |

OTHER PUBLICATIONS

The article entitled "Technical Manual", Baker Oil Tools Inc., Sep. 1973.

*Primary Examiner*—James A. Leppink
*Assistant Examiner*—Hoang C. Dang
*Attorney, Agent, or Firm*—James R. Duzan; E. Harrison Gilbert, III

[57] ABSTRACT

A well tool having reciprocating portions can be locked in a predetermined position by a latching mechanism which is responsive to externally applied pressure, as opposed to mere movement of the reciprocating elements to the predetermined position. The actuating pressure can be applied through the annulus or through a pipe string in which the tool is located.

13 Claims, 6 Drawing Figures

WELL TOOL HAVING LATCHING MECHANISM AND METHOD OF UTILIZING THE SAME

BACKGROUND OF THE INVENTION

This invention relates generally to tools having moving parts which can be locked in a particular position for use with a pipe string disposed in a well and a method of using the same. More particularly, but not by way of limitation, this invention relates to a reciprocating ball valve tubing tester tool having a pressure responsive latching mechanism and a method of testing a pipe string with the same.

It is well known that there is the need for a tester valve tool used in a pipe string for controlling fluid flow by which the pipe string can be pressure tested to determine if there are any leaks in the pipe string. This is important so that any leaks can be detected relatively near the surface and fixed before higher pressure fluids are allowed to flow into or out of the pipe string. For example, such testing is needed prior to a squeeze-cementing or treating job. Because additional joints of pipe are added to the pipe string as the pipe string is lowered into the well, such testing often must be repeated so that the valve must be opened and closed several times before the ultimate work to be accomplished (e.g., the squeeze-cementing or treating job) is performed. After the testing is completed, however, the valve should be locked in a desired position, such as in an open position so that any subsequent, non-testing fluid flow is neither obstructed nor controlled by the tester valve. Therefore, there is the need for a tester valve with a locking or latching mechanism to lock the valve in such a desired position.

Tester valves of various types are well-known and types of valves which can be locked in an open or a closed position are also known; however, the locking or latching types of which I am aware are automatically operable in that locking or latching automatically occurs when the valve is moved to the position in which it is to be locked. That is, there is no additional controllable force required to be exerted on the latching device for it to operate once the valve is placed in the desired position. Thus, if such a valve is inadvertently moved to such locking position, it is automatically locked and cannot be unlocked until it is retrieved to the surface. Therefore, there is the need for a latching mechanism which must be positively acted upon or controlled other than by a passive biasing force which automatically operates as soon as the valve has moved to the locking position so that inadvertent (or even intentional) movement of the valve alone will not lock the valve. Such a positive acting force could be by an annular pressure applied under control from the surface, for example.

Such a novel valve should also be relatively simple to maintain, such as by constructing the latching mechanism so that it can be easily reset or released without disassembling the entire tool. By meeting the aforementioned needs, no J-slot need be used, thereby eliminating the maintenance problems associated with J-slots (e.g., lug wear).

Such a novel valve should also be constructed to enhance cost savings, such as by utilizing existing parts from other equipment and by compactly constructing the tool to reduce both material and machining costs.

Although the foregoing needs have been expressed with respect to a specific type of tool, namely a tester valve tool, such a latching mechanism should be constructed to have utility within other types of tools.

SUMMARY OF THE INVENTION

The present invention meets the foregoing needs by providing a novel and improved tool having a latching mechanism and a method of utilizing the same. In the preferred embodiment, the latching mechanism is used in combination with a reciprocating ball valve for pressure testing a pipe string as it is lowered into a well, for example. The latching mechanism of the present invention requires a positive acting force to be applied thereto once the tool has been placed in the position in which it is to be locked. In the preferred embodiment the latching mechanism is responsive to either an internal pressure exerted through the pipe string or to an annular pressure exerted through the annulus between the pipe string and the well.

The present invention is constructed so that it can be reset or released by simply removing only one threaded connector forming part of the latching mechanism, thereby obviating the need to further disassemble the tool. No J-slot is required; therefore, there is no lug wear or other maintenance problems which may be associated with J-slots. The preferred embodiment valve of the present invention can, to a certain extent, be constructed of existing parts; however, it is more compactly constructed than at least some other types of tester valves so that material and machining costs are reduced. Fewer O-rings are used in the preferred embodiment, thereby also reducing cost and maintenance.

Broadly, the apparatus of the present invention includes a first support structure having means for connecting with a pipe string; a second support structure connected in relative axial sliding cooperation with the first support structure so that the tool is reciprocatable between a first working position, wherein the first and second support structures are in a first relative position, and a second working position, wherein the first and second support structures are in a second relative position; and latch means, slidably retained on the first and second support structures, for latching the first and second support structures together so that further relative axial movement therebetween is prevented when the latch means is axially moved into latching engagement with both of the first and second support structures. In the preferred embodiment, the latch means includes means for receiving an axially acting pressure so that the latch means moves in response thereto. This axially acting pressure can be exerted by a pressure applied through the pipe string or a pressure applied through the annulus.

More particularly, the latch means includes a latch member; a slide member having first engagement means for engaging the latch member and having second engagement means for engaging the second support structure; and biasing means for biasing the latch member into latching engagement with the first support structure when the slide member moves so that the second engagement means is in latching engagement with the second support structure. The latch means further includes retainer means, releasably connected to the slide member, for releasably retaining the latch member with the slide member so that the latch member can be disengaged from the first support structure by releasing the retainer means from the slide member and relieving the biasing means from biasing the latch member.

By the method of the present invention a pipe string disposed in a well can be tested through steps including reciprocating the pipe string to open and close a valve disposed in the pipe string; applying a pressure to the pipe string when the valve is closed to determine if the pipe string leaks; moving the pipe string to place the valve in an open position; and exerting a force on a slide member disposed adjacent the valve so that the slide member moves locking shoulders associated therewith into latching engagement with the valve when the valve is in the open position, whereby the valve is locked open. In the preferred embodiment the step of exerting a force is implemented by pressurizing a selectable one of a fluid within the annulus and a fluid within the pipe string for creating a force in excess of a predetermined holding force acting on the slide member.

Therefore, from the foregoing, it is a general object of the present invention to provide a novel and improved well tool having a latching mechansim and a method of utilizing the same. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1A:
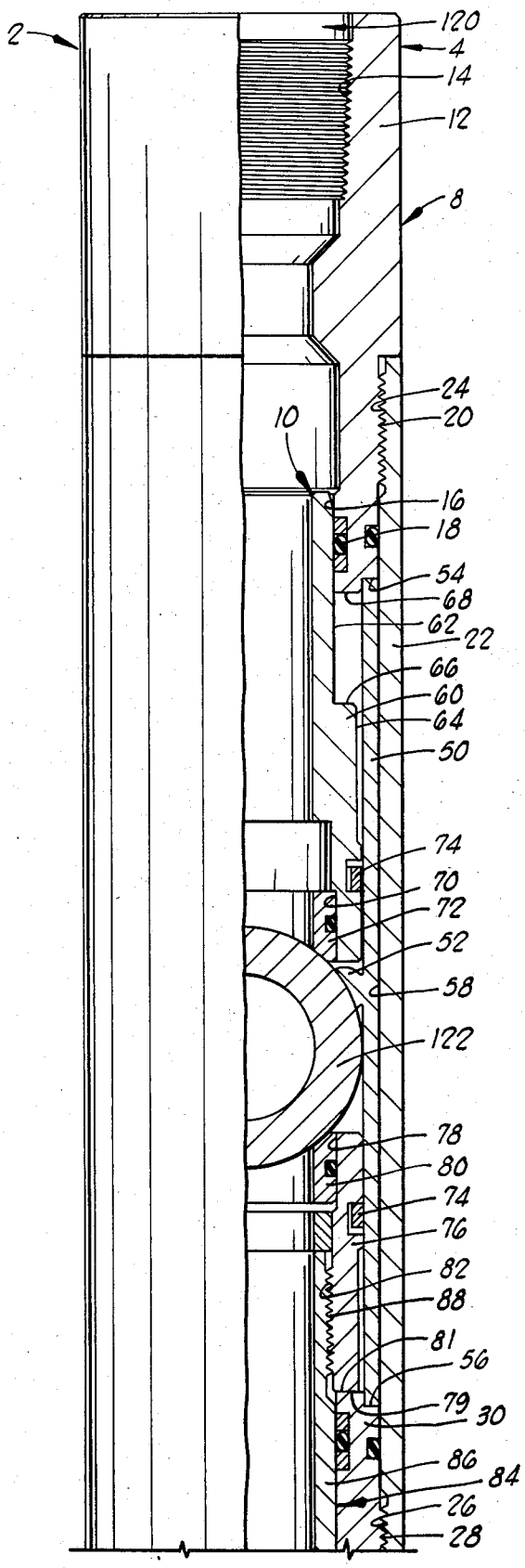
FIGS. 1A and 1B are a partial sectional elevational view of a preferred embodiment of the present invention including a valve disposed in a closed position.

The preferred embodiment of the present invention will be described initially with reference to FIGS. 1A–1B. FIGS. 2A–2B and FIGS. 3A–3B will subsequently be referred to and described with reference primarily to the operation of the present invention; however, the parts shown therein are the same as those shown in FIGS. 1A–1B as indicated by the like reference numerals, although with relative position changes as shown.

The present invention will be described with reference to a reciprocating ball valve tubing tester tool 2; however, aspects of the present invention are contemplated as having utility with other types of tools having reciprocating, or axially or telescopingly movable, structures that need to be locked in desired positions. Thus, broadly the present invention comprises two support structures, connected in relative axial sliding cooperation with each other so that the structures are reciprocatable between two working positions wherein the support structures are in two different relative positions, and latch means, slidably retained on the two support structures, for latching the support structure together so that further relative axial movement therebetween is prevented when the latch means is axially moved into latching engagement with both of the support structures.

Figure 1B:
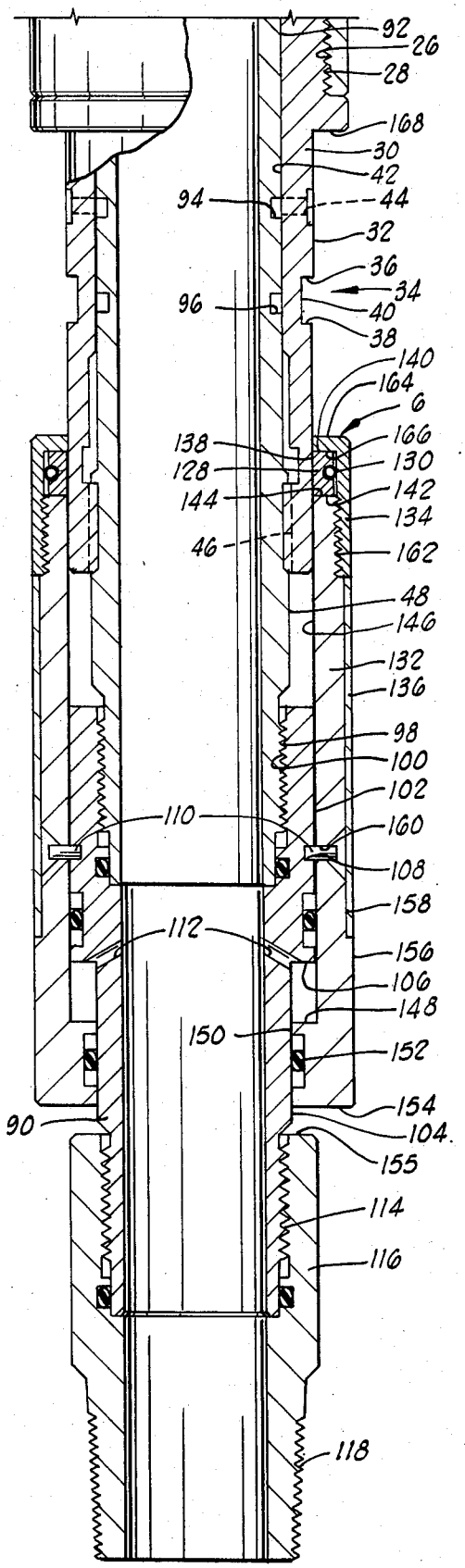

For the specific embodiment shown in FIGS. 1A–1B, the two support structures define a housing of a valve 4 of the tubing tester tool 2, which tool 2 also includes a latch mechanism 6 defining the preferred embodiment of the aforementioned latch means. One support structure of the housing of the valve 4 includes an outer valve housing portion 8, and the other support structure includes an inner valve housing portion 10.

The outer valve housing portion 8 includes an upper adapter 12 having an internally threaded surface 14 for connecting with a pipe string in which the preferred embodiment of the present invention is contemplated to be used. The adapter 12 also includes an inner surface 16 along which a portion of the inner valve housing portion 10 is slidably disposed and in which a suitable sealing member 18 is disposed. The adapter 12 has a threaded external surface 20 to which an outer valve casing 22 is threadedly connected.

The outer valve casing 22, which is another part of the outer valve housing portion 8, is a cylindrical sleeve having an internally threaded end surface 24 for threadedly engaging with the surface 20 and also having a threaded end surface 26 for threadedly engaging with a threaded surface 28 of a locking dog adapter 30 forming another part of the outer valve housing portion 8.

The locking dog adapter 30 has a cylindrical exterior surface 32 in which an indentation 34 is formed. The indentation 34 of the preferred embodiment is a circumferential groove defined by opposing annular surfaces 36, 38 separated by a circumferential surface 40 radially inwardly offset from the surface 32. The surface 38 defines an engagement shoulder for engaging with the latching mechanism 6 as subsequently described hereinbelow.

Formed between the outer surface 32 and an inner surface 42 of the locking dog adapter 30 are one or more holes 44 for receiving one or more frangible members, such as shear pins, by which the tester valve 4 can be preset in a selectable position.

At the lower end (as viewed in the drawings) of the inner surface 42 of the locking dog adapter 30, there are defined a plurality of splines 46 for mating engagement with complementally formed splines 48 on the inner valve housing portion 10 whereby rotary motion imparted to one of the housing portions is coupled to the other housing portion.

Retained in a fixed position within the outer valve housing portion 8 is an actuating arm 50 having a lug 52 extending radially inwardly therefrom for engaging a valve member subsequently described. The actuating arm 50 extends axially between a notch surface 54 of the adapter 12 and a notch surface 56 of the adapter 30 and is disposed radially adjacent an inner surface 58 of the outer valve casing 22.

Figure 2A:
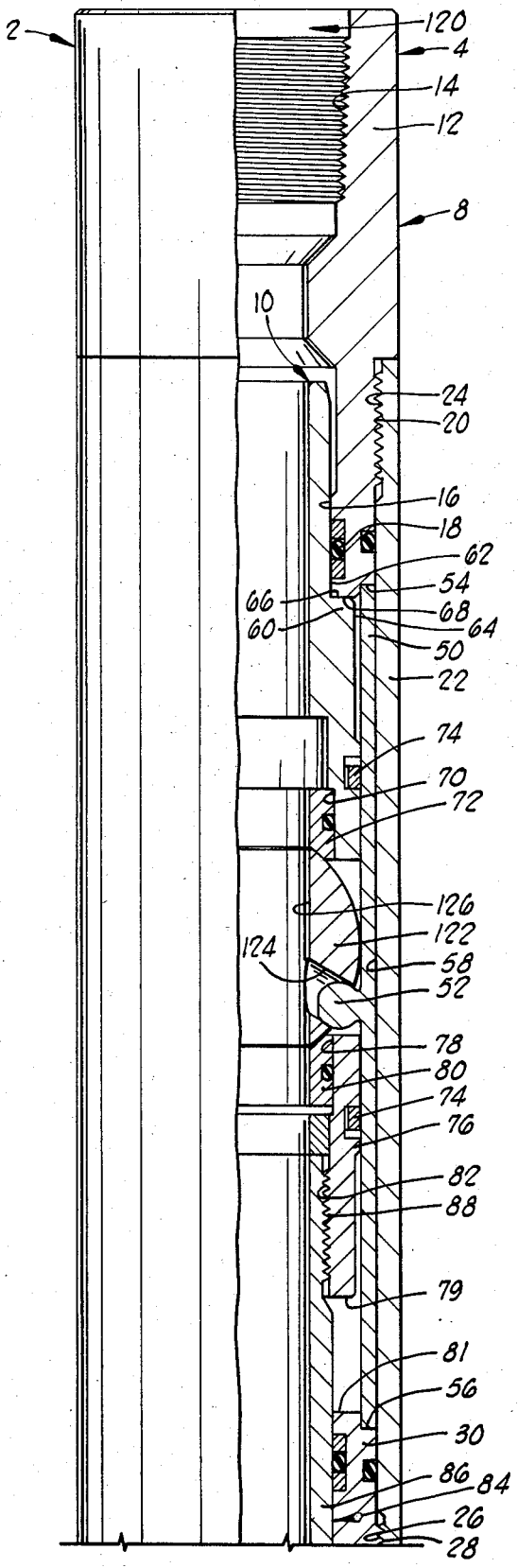
FIGS. 2A and 2B are a partial sectional elevational view of the preferred embodiment shown in FIGS. 1A and 1B with the valve shown in an open position and a latching mechanism shown in an unlatched position.
Figure 2B:
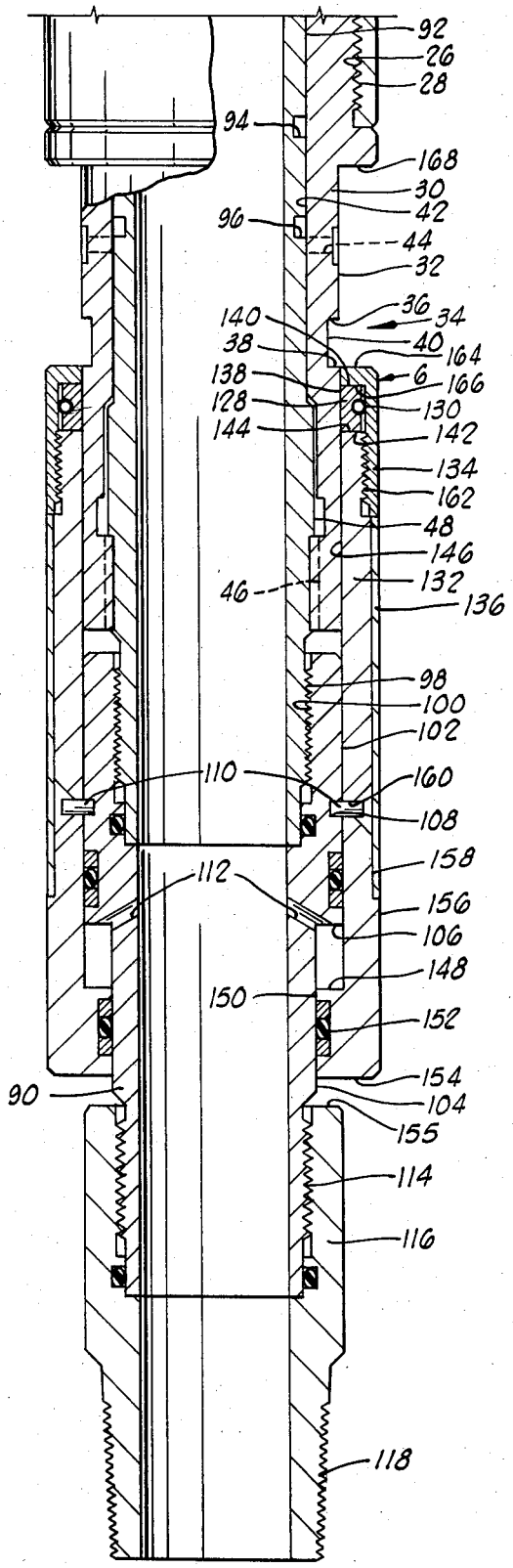

The inner valve housing portion 10 includes a positioning or guide mandrel and upper valve seat carrier element 60 having offset outer surfaces 62, 64 radially separated by an annular surface 66 which abuts an end surface 68 of the adapter 12 when the tester valve 4 is in an open position as shown in FIGS. 2A–2B, for example. The surface 62 is disposed adjacent the surface 16 of the adapter 12 for relative sliding movement therealong. The member 60 also has a recessed inner surface 70 at its lower end for receiving an upper valve seat 72 forming another part of the inner valve housing portion 10.

Connected to the element 60 by means of a suitable clamping element 74 is a lower valve seat carrier 76 having a recessed inner surface 78 adjacent which a lower valve seat 80 is disposed. The lower valve seat carrier 76 has an annular end surface 79 which abuts an annular end surface 81 of the adapter 30 to prevent further outer telescoping movement between the housing portions 8, 10 when the valve 4 is in its closed position as shown in FIG. 1A. The lower valve seat carrier 76 also has a threaded inner surface 82 threadedly connected to a moving mandrel 84 including an upper portion 86, having a threaded outer surface 88 connected with the surface 82, and a lower portion 90.

The upper portion 86 is a substantially cylindrical sleeve having an outer surface 92 in which two indentations 94, 96 are formed for receiving the ends of one or more shear pins disposed through the one or more holes 44 formed through the locking dog adapter 30. The indentations 94, 96 are circumferential grooves in the preferred embodiment spaced a predetermined distance apart so that the valve 4 can be preset in either a closed position (via indentation 94) or an open position (via indentation 96). The outer surface 92 of the upper portion 86 also includes the aforementioned splines 48. The lower end of the upper portion 86 has an externally threaded surface 98 for threadedly engaging with a threaded interior surface 100 of the lower portion 90.

The lower portion 90 has an exterior surface 102 radially outwardly offset from another exterior surface 104. The separation between the surfaces 102, 104 is defined by an annular surface 106 defining another engagement shoulder for engaging with the latching mechanism 6. The surface 106 faces in an opposite direction (namely downwardly as viewed in the drawings) relative to the surface 38 (which is upwardly facing as viewed in the drawings) defining the first-mentioned engagement shoulder. The surfaces 38, 106 are spaced by a distance which is variable between the maximum distance, depicted in FIG. 1B, when the valve is fully closed and the lesser, minimum distance, depicted in FIGS. 2B and 3B, when the valve is fully open. The surfaces 104, 106 can be said to define an indentation for defining the engagement shoulder.

Defined in the exterior surface 102 is an indentation 108 specifically defined in the preferred embodiment as a circumferential groove for receiving one or more shear pins 110, which pins are a part of the preferred embodiment of the latch mechanism 6.

Formed through the side wall of the lower portion 90 are one or more ports 112 by which fluid and pressure communication occurs between the interior and exterior of the lower portion 90. As illustrated in the preferred embodiment, the ports are angularly disposed and intersect at the adjoining corner of the surfaces 104, 106.

Formed at the lower exterior end of the lower portion 90 is a threaded surface 114 for threadedly engaging a lower adapter 116 forming another part of the inner valve housing portion 10 of the preferred embodiment. The adapter 116 has a threaded end 118 for coupling with the pipe string or a packer or other element of a type as known to the art.

Each of the aforementioned elements of the outer valve housing portions 8, 10 has a central axial opening defined therethrough so that the telescopically associated housing portions 8, 10 have a central axial flow passage 120 defined throughout the length thereof.

In addition to the housing portions 8, 10, the valve 4 of the preferred embodiment includes a rotatable, reciprocatable valve member 122 having a spherical shape in which an eccentric hole 124 is defined for receiving the lug 52 of the actuating arm 50. As shown in FIG. 2A, the valve member 122 has a bore 126 defined therethrough for aligning with the passage 120 when the valve member 122 is moved to the open position depicted in FIGS. 2A–2B and 3A–3B. When the valve member 122 is in the closed position depicted in FIGS. 1A–1B, the closed side wall of the valve member 122 is sealingly seated between the valve seats 72, 80 to block the passage 120, thereby closing the valve 4 to through fluid flow. Because the valve member 122 is retained between the valve seats 72, 80, it moves with the inner valve housing portion 10 relative to the outer valve housing portion 8.

Figure 3A:
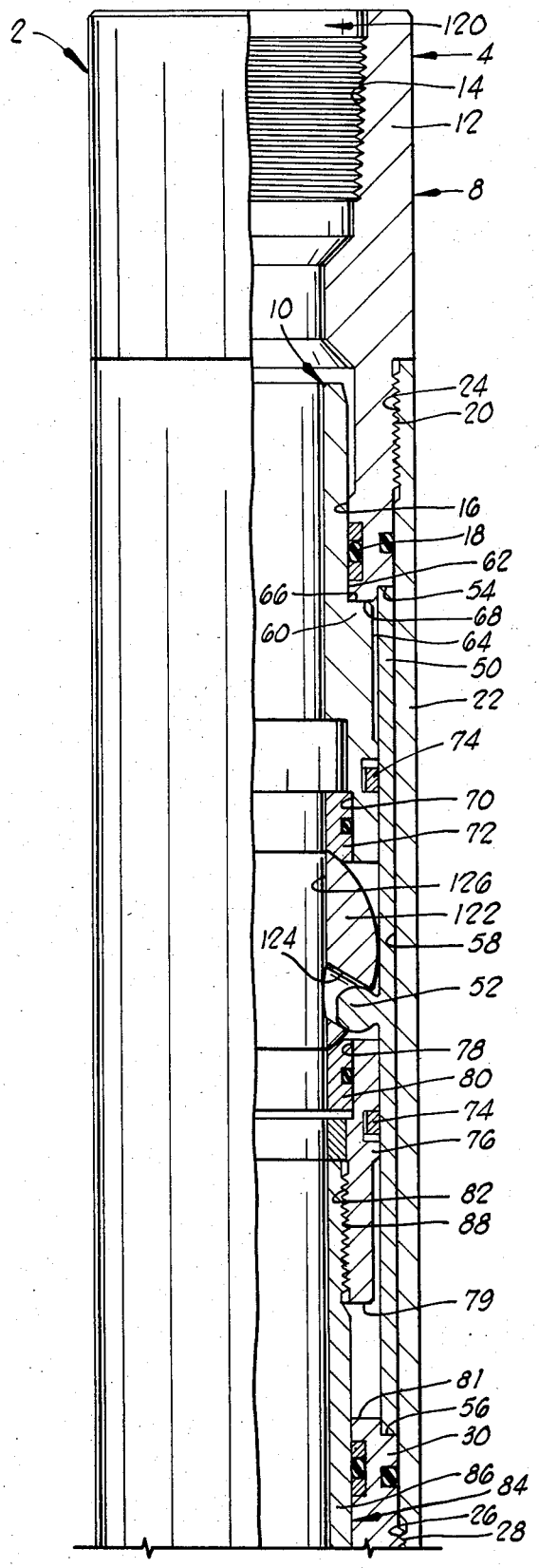
FIGS. 3A and 3B are a partial sectional elevational view of the preferred embodiment with the valve shown in the open position and the latching mechanism shown in a latched position, whereby the valve is locked open.
Figure 3B:
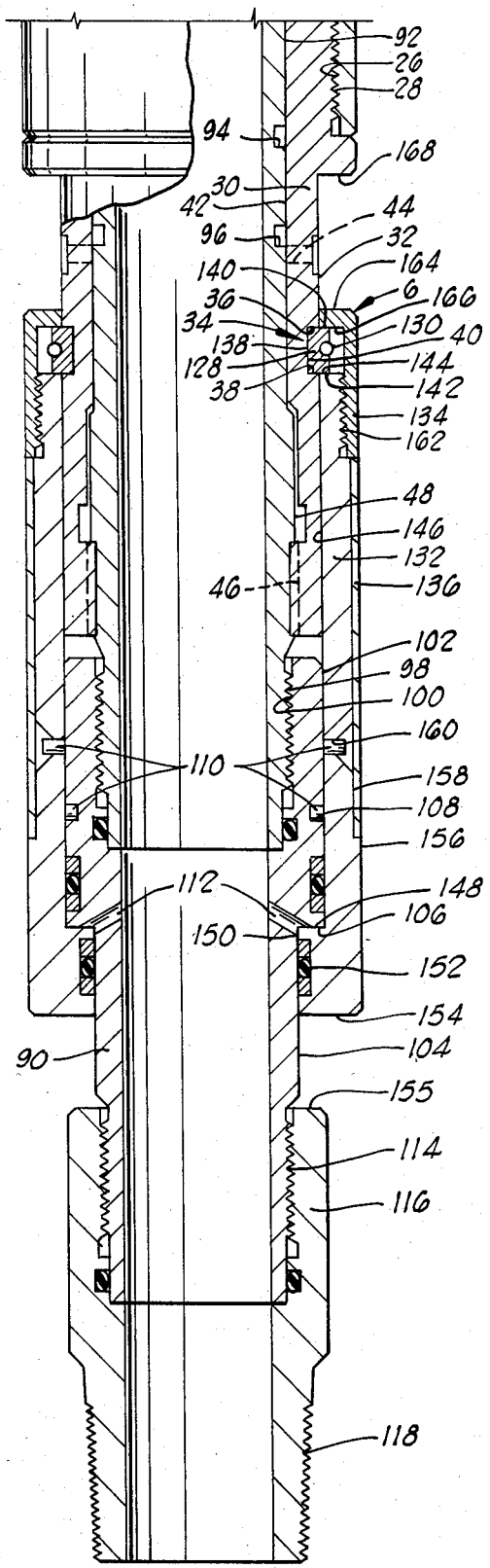

The preferred embodiment of the latching mechanism 6, shown in FIGS. 1A–1B and 2A–2B in its unlatched position whereby the valve 4 can be opened and closed through reciprocating action between the outer and inner housing portions 8, 10 and shown in its latched position in FIGS. 3A–3B whereby the valve 4 is locked in its open position, includes a latch member 128, biasing means 130, a slide member 132, retainer means 134, and holding means including the one or more shear pins 110 and a shear pin retaining sleeve 136.

The preferred embodiment of the latch member 128 includes a split-ring locking dog which in its unlatched position rides so that an inner surface 138 thereof rides adjacent the exterior surface 32 of the locking dog adapter 30. Extending radially outwardly from the surface 138 are end surfaces 140, 142 which are spaced a distance less than the separation of the surfaces 36, 38 of the indentation 34 so that the latch member 128 will be received in the indentation 34 when the latching mechanism 6 is moved to its latched position. When the latch member 128 is so received within the indentation 34, the surface 142 acts as an engagement shoulder for engaging the engagement shoulder defined by the surface 38.

To bias or urge the latch member 128 into the indentation 34, the latch mechanism 6 includes the biasing means 130 which in the preferred embodiment includes a suitable compressive member, such as a ratcheting spring or an O-ring. Thus, when the latch member 128 is moved over the indentation 34 as subsequently described, the natural biasing of the member 130 biases the latch member 128 into latching engagement within the indentation 34.

Movement of the latch member 128 into overlying relationship with the indentation 34 occurs through movement of the slide member 132, which is responsive to a selectable one of a pressure applied through the pipe string communicated through one or more of the ports 112 or a pressure applied through the annulus or space defined between the tool 2 and the well in which it is disposed. The slide member 132 includes an upper annular surface 144 defining an abutment shoulder or engagement means for engaging the surface 142 of the latch member 128. Extending downwardly from the surface 144 is an axially extending cylindrical interior surface 146 disposed adjacent portions of both housing portions 8, 10 as shown in the drawings. Extending radially inwardly from the lower end of the interior surface 146 is an inner annular surface 148 defining engagement means for engaging the surface 106 of the inner valve housing portion 10. The surface 148 also defines means for receiving an axially acting pressure, communicated through the ports 112 from within the tool 2 and the pipe string to which it is connected, for moving the latching mechanism 6. Extending axially from the surface 148 in radially inwardly offset relationship to the interior surface 146 is an interior surface 150 having a sealing member 152 disposed therein. The surface 150 is disposed in sliding relationship along the surface 104 of the lower portion 90 of the moving mandrel of the inner valve housing portion 10. Extending radially outwardly from the surface 150 at the lower end of the slide member 132 is an outer annular surface 154 disposed for receiving a pressurized fluid communicated through the annulus. The surface 154 is spaced from an annular end surface 155 of the adapter 116 so that a gap is defined therebetween to permit movement of the slide member 132 towards the adapter 116 as subsequently described. The surfaces 148, 150, 154 define a rim portion of the slide member 132, which rim portion extends radially inwardly in overlapping relationship with the surface 106 so that the surfaces 106, 148 engage when the pressure acting on the surface 154 is sufficiently large to move the slide member 132 upwardly as viewed in the drawings. When the surfaces 106, 148 engage, the latch member 128 is disposed over the indentation 34 and thus enters the indentation 34 in response to the biasing of the biasing means 130. So that this is achieved, the axial length of the interior surface 146 is such that it spaces the surface 148 of the slide member 132 and the surface 142 of the latch member 128 a distance equal to the aforementioned minimum spacing between the engagement surfaces 38, 106 of the valve 4, which minimum spacing occurs in the preferred embodiment only when the valve 4 is placed in its fully open position. For this construction of the preferred embodiment, the latching mechanism 6 can thus be operated to latch the inner and outer valve housing portions 8, 10 only when the housing portions 8, 10 are in the relative position placing the valve member 122 in its fully open position.

The slide member 132 also has an axially extending exterior surface 156 having an axially extending recessed portion 158. Extending between areas of the recessed surface 158 and the interior surface 146 are one or more holes 160 for receiving the one or more shear pins 110. When the slide member 132 is in the unlatched position as shown in FIGS. 1A–1B and 2A–2B, the holes 160 are aligned with the holes 108 of the lower portion 90 so that the shear pins can be received therebetween to hold the latching mechanism 160 in its unlatched position.

Extending axially from the outer edge of the annular surface 144 to the recessed surface 158 is a threaded surface 162 for threadedly engaging with the retainer means 134.

In the preferred embodiment the retainer means 134 is a cap having an outer annular surface 164 and an inner annular surface 166. The inner annular surface 166 is spaced from the annular surface 144 of the slide member 132 sufficiently to define a space for holding the latch member 128. When the latching mechanism 6 is in its latched position, the retainer means 134 can be unthreaded from its connection with the slide member 132 so that this is the only disassembly required to obtain access to the latch member 128 and the biasing means 130 for unlatching the mechanism when the tool 2 is retrieved to the surface. Once the retainer means 134 is unthreaded from its connection with the slide member 132, it is moved upwardly through a sufficient distance provided by constructing the tool 2 so that it has an appropriate spacing between a surface 168, extending radially outwardly from the surface 32 of the locking dog adapter 30, and the surface 164 when the latching mechanism 6 is in its latched position.

In addition to retaining the latch member 128 adjacent and in movable relationship with the slide member 132, the retainer means 134 also retains the shear pin retaining sleeve 136 within the recessed portion defined by the surface 158 of the slide member 132. When the retainer means 134 is released from the slide member 132 so that the latch member 128 can be disengaged, the shear pin retaining sleeve 136 can also be moved upwardly to uncover the holes 160 whereby new shear pins 110 can be installed.

In the preferred embodiment, the shear pins 110 define a specific type of frangible means for holding the slide member 132 with a predetermined holding force in a fixed position relative to at least one of the housing portions 8, 10 until the frangible means is broken in response to a pressure exceeding a predetermined magnitude such as could be exerted by a pressurized fluid communicated to one of the surfaces 148, 154 of the slide member 132. To retain and protect the shear pins 110, the shear pin retaining sleeve 136 is disposed in overlying relation to the shear pins 110 and the shear pin receiving holes 160 as shown in the drawings.

The preferred embodiment reciprocating ball valve tubing tester tool 2 is used, for example, to pressure test the pipe string in which it is connected as many times as desired before a squeeze-cementing or treating job. This permits the operator to locate leaks in the pipe string while the leaks are near the surface. To perform such pressure testing, for example, the valve 4 is opened or closed by compression or tension, respectively, applied to the tool 2 by movement of the pipe string. Alternate compression and tension is applied, whereby alternate opening and closing is achieved, by reciprocating the pipe string. When running in the hole, for example, the force of pushing the pipe string downward can put the tool 2 into compression and the ball valve will open to a position such as is shown in FIGS. 2A–2B. In moving to this position, the inner and outer valve housing portions 8, 10 exhibit relative motion so that the lug 52 and valve member 122 interact to rotate the valve member 122 into the position shown in FIG. 2A. This is the fully open position for the valve member 122; however, despite being in this fully open position, wherein the valve housing portions 8, 10 are in their fully compressed or inwardly telescoped relative position, the latching mechanism 6 has not been activated by this movement. Because the latching mechanism 6 has not latched, the valve member 22 can be repeatedly opened and closed to repeatedly perform the pressure testing. To close the valve member from the position shown in FIGS. 2A–2B, tension is pulled on the pipe string to return the valve member 122 to the closed position shown in FIGS. 1A–1B. During such unlatched movement, the slide member 132 is held fixed relative to the inner valve housing portion 10 by means of the predetermined holding force exerted by the one or more shear pins 110.

When the valve member 122 is in its closed position, pressure is applied to the pipe string to determine if any leakage occurs. This step is performed in a manner known to the art.

Once the tubing tester tool 2 has been used for its purpose of testing the pipe string, and when the pipe string has been lowered into the well to the desired depth, a packer of a known test is set in a manner as known to the art to seal the annulus so that fluid flow therethrough is blocked. Such a packer is connected in a known manner below the tool 2. When the packer has been set, the weight of the pipe string can be allowed to compress the tool 2 so that its is moved into its open position as shown in FIGS. 2A–2B and 3A–3B. With the packer set, it is normal procedure to apply a pressure to the annulus defined between the pipe string and the well to test the packer seal. When this pressure is applied, it simultaneously acts on the surfaces 154, 164 of the latching mechanism 6. Because the surface 154 has a greater cross-sectional area than the surface 164, the net force exerted by this pressure will be in an axially upward direction as viewed in the drawings. When this net force exceeds the holding force established by any shear pins 110 which are used (and any counterforce exerted by an internal pressure through the ports 112), the shear pins 110 are broken and the slide member 132 is moved upwardly until the surface 148 engages the surface 106 and the latch member 128 enters the indentation 34 whereupon the surface 142 engages the surface 38. Through these engagements of the surfaces 106, 148 and 38 and 142, the inner and outer valve housing portions 8, 10 are fixed in their relative valve-open position so that no further axial movement therebetween can occur. In the preferred embodiment, this locks the valve in the open position. By locking the valve member 122 in its open position, no further control of fluid flow can be achieved with the tool 2 until it is retrieved to the surface and the latching mechanism 6 is released by simply disconnecting just the cap of the retainer means 134 to obtain access to the latch member 128. That is, the latching mechanism 6, and the locking shoulders thereof, can be released without disassembling any part of the valve itself. Locking the valve member 122 in the open position also allows fluid trapped inside the pipe string to drain out while the string is being retrieved from the hole.

An alternative to the use of the annular pressure to break the hold of the shear pins 110 is the use of pressure within the pipe string and the tool 2 as communicated through the ports 112 for axially acting between the surfaces 106, 148. When the internal pressure is sufficient to overcome the holding force of the shear pins 110 (and any external force exerted by an annulus pressure), the slide member 132 is moved downwardly a sufficient amount which is allowed due to the spacing between the surfaces 154, 155 shown in FIG. 1B, for example. Once the shear pins 110 have been broken by the internal pressure, the annular pressure can thereafter act to move the slide member 132 upwardly to achieve the latching as previously described.

As an optional feature of the preferred embodiment, there are included the one or more shear pin holes 44 and the two grooves 94, 96 by which the valve 4 can be held in a preset position until the action imparted by the pipe string breaks the one or more optional shear pins. If a shear pin is used with the groove 94, the valve is preset in a closed position; if it is used with the groove 96, the valve is preset in an open position, which positions are such that sufficient additional relative axial movement between the housing portions 8, 10 is permitted so that the pins can be sheared by such additional movement.

From the foregoing it is apparent that the present invention offers a flexibility of operation in that the ball valve can be positioned in an open or closed position when running downhole by using the optional shear pin disposed through the one or more holes 44. Furthermore, the ball valve can be opened or closed repeatedly without the valve being automatically or inadvertently locked by only the opening and closing movement of the valve. To lock the present invention, the locking mechanism must be positively acted upon by a suitable force derived from other than just the opening or closing movement of the valve.

Furthermore, the present invention has a simplified construction which permits simplified maintenance. In particular, only one threaded connection needs to be undone to reposition the locking mechanism. Furthermore, no J-slot is used and fewer O-rings than in at least some other existing designs are used. Also, many existing parts previously known can be used. Material and machining costs have been reduced by constructing the preferred embodiment with a shorter length than in an existing tubing tester tool.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts and in the performance of steps can be made by those skilled in the art, which changes are encompassed within the spirit of this invention as defined by the appended claims.

What is claimed is:

1. A tester tool for controlling fluid flow through a pipe string disposed in a well comprising:

a first valve housing portion having a first engagement shoulder defined therein;

a second valve housing portion having a second engagement shoulder defined therein, said second valve housing portion slidably connected with said first valve housing portion;

a valve member movably retained within said first and second housing portions; and latch means, slidably disposed adjacent said first and second housing portions, for moving, in response to an applied pressure, between an unlatched position, wherein said first and second housing portions can move relative to each other, and a latched position, wherein said first and second housing portions are latched to prevent relative movement, said latch means having third and fourth engagement shoulders defined therein for engaging said first and second engagement shoulders when said latch means is moved by the applied pressure to said latched position, wherein said latch means includes:

a slide member having a surface defining said fourth engagement shoulder;

a locking dog having a surface defining said third engagement shoulder; and retainer means for retaining said locking dog with said slide member so that said locking dog is moved by said slide member.

2. A tester tool as defined in claim 1, wherein said slide member is disposed for receiving, against said surface defining said fourth engagement shoulder, a pressurized fluid communicated through said housing portions and wherein said slide member further has another surface disposed for receiving thereagainst a pressurized fluid communicated through an annulus defined between said tool and the well.

3. A tester tool as defined in claim 2, wherein said latch means further includes frangible means for holding said slide member in a fixed position relative to one of said housing portions until said frangible means is broken in response to a force exceeding a predetermined magnitude exerted by a pressurized fluid communicated to one of said surfaces of said slide member.

4. A tester tool as defined in claim 1, wherein:

said valve member is movable, in response to relative movement between said housing portions, between a fully closed position, wherein said first and second engagement shoulders are disposed a first distance apart, and a fully open position, wherein said first and second engagement shoulders are disposed a second distance apart which is less than said first distance, when said latch means is in said unlatched position; and said third and fourth engagement shoulders are spaced from each other by a distance equal to said second distance so that said latch means can be moved to said latched position only when said valve member is in said fully open position.

5. A tester tool as defined in claim 1, wherein:

said first valve housing portion includes a locking dog adapter having an exterior surface in which a first indentation is formed for defining said first engagement shoulder;

said second valve housing portion includes a mandrel, telescopingly received within said locking dog adapter, having an exterior surface in which a second indentation is formed for defining said second engagement shoulder; and said latch means includes:

a slide member haivng an interior surface disposed adjacent portions of said exterior surfaces of said first and second valve housing portions and having at one end a rim portion extending inwardly from said interior surface for defining said fourth engagement shoulder and having at another end an abutment shoulder; and a locking dog defining said third engagement shoulder and retained adjacent said abutment shoulder for movement into engagement with said first engagement shoulder within said first indentation when said slide member moves so that said fourth engagement shoulder engages said second engagement shoulder.

6. A tester tool as defined in claim 5, wherein:

said rim portion includes an outer annular surface for receiving thereagainst an outer pressure from within an annulus defined between said tool and the well and said rim portion also includes an inner annular surface defining said fourth engagement shoulder; and said mandrel has a port defined therethrough for communicating an inner pressure within said tool with said inner annular surface so that said inner pressure acts on said inner annular surface.

7. A tester tool as defined in claim 6, wherein said latch means further includes holding means for holding said slide member with a predetermined force in a fixed position relative to said mandrel until either said inner pressure or said outer pressure exerts on said slide member a net force greater than said predetermined force.

8. A tester tool as defined in claim 7, wherein said holding means includes:

a shear pin disposed through said slide member into engagement with said mandrel; and a shear pin retaining sleeve slidably received along an exterior surface of said slide member in overlying relation to said shear pin.

9. A tester tool as defined in claim 8, wherein said latch means further includes retainer means, threadedly connected to said slide member, for releasably retaining said locking dog and said shear pin retaining sleeve adjacent said slide member.

10. A tester tool as defined in claim 5, wherein said latch means further includes retainer means threadedly connected to said slide member, for releasably retaining said locking dog adjacent said slide member when said retainer means is connected to said slide member so that said locking dog is releasable from said first indentation when said retainer means is disconnected from said slide member, whereby said tool can be reset without other disassembly of said tool.

11. A method of testing a pipe string disposed in a well, comprising:

reciprocating the pipe string to open and close a valve connected within the pipe string, said step of reciprocating the pipe string to place the valve in an open position includes:

setting a packer, connected to the pipe string to seal an annulus between the pipe string and the well so that fluid flow therethrough is blocked; and applying a force to the pipe string to move the valve to the open position;

applying a pressure to the pipe string when the valve is closed to determine if the pipe string leaks;

moving the pipe string to place the valve in an open position; and exerting a force on a slide member disposed adjacent the valve so that the slide member axially moves locking shoulders associatd therewith into latching engagement with the valve when the valve is in the open position, whereby the valve is locked open, said step of exerting a force on the slide member includes pressurizing a fluid within the annulus for testing the seal established by the set packer and simultaneously moving the slide member.

12. A method as defined in claim 1, wherein:

said method further comprises, during the step of reciprocating the pipe string, holding the slide member adjacent a portion of the valve with a predetermined holding force; and said step of exerting a force on the slide member includes pressurizing a selectable one of a fluid within the annulus and a fluid within the pipe string for applying against the slide member a force in excess of the predetermined holding force acting on the slide member.

13. A method as defined in claim 11, further comprising:

pulling the pipe string from the well; and releasing the locking shoulders from the latching engagement with the valve without disassembling the valve.

* * * * *